US006530206B2

(12) United States Patent
Fietz

(10) Patent No.: US 6,530,206 B2
(45) Date of Patent: Mar. 11, 2003

(54) SUPPORTING DISK

(75) Inventor: Roland Fietz, Neustadt (DE)

(73) Assignee: Firma Carl Freudenberg, Weinheim (DE)

( * ) Notice: Subject to any disclaimer, the term of this patent is extended or adjusted under 35 U.S.C. 154(b) by 0 days.

(21) Appl. No.: 09/962,577

(22) Filed: Sep. 24, 2001

(65) Prior Publication Data

US 2002/0124547 A1 Sep. 12, 2002

(30) Foreign Application Priority Data

Sep. 19, 2000 (DE) ..... 100 46 525

(51) Int. Cl.[7] ..... D01H 4/00
(52) U.S. Cl. ..... 57/406
(58) Field of Search ..... 57/92, 103, 406, 57/407, 404; 384/549

(56) References Cited

U.S. PATENT DOCUMENTS

| | | | | | |
|---|---|---|---|---|---|
| 4,892,422 | A | * | 1/1990 | Stahlecker | 384/295 |
| 5,221,133 | A | * | 6/1993 | Braun et al. | 384/549 |
| 5,399,028 | A | * | 3/1995 | Raasch | 384/549 |
| 5,517,814 | A | * | 5/1996 | Stahlecker | 384/549 |
| 5,692,369 | A | * | 12/1997 | Braun | 57/112 |
| 5,749,215 | A | * | 5/1998 | Harrison et al. | 29/894.32 |
| 5,799,478 | A | * | 9/1998 | Legrom | 57/264 |
| 5,960,623 | A | * | 10/1999 | Legrom | 57/263 |
| 6,016,649 | A | * | 1/2000 | Bock et al. | 57/404 |
| 6,116,012 | A | * | 9/2000 | Braun | 384/549 |

* cited by examiner

*Primary Examiner*—Danny Worrell
(74) *Attorney, Agent, or Firm*—Kenyon & Kenyon

(57) ABSTRACT

Supporting disk for supporting a rotor of an open-end spinning machine, including a hub ring (1) and a supporting ring made of polymeric material secured to its outer circumference (2). The hub ring (1) is formed as a composite part, and is made of at least two different materials.

20 Claims, 8 Drawing Sheets

SUPPORTING DISK

BACKGROUND OF THE INVENTION

The present invention relates to a supporting disk for supporting a rotor of an open-end spinning machine, including a hub ring and a supporting ring made of polymeric material affixed to its periphery.

BACKGROUND INFORMATION

Such supporting disks are generally known, the hub ring being made exclusively of a metallic material, such as aluminum, or made exclusively of a nonmetallic material, such as a polymeric material.

The advantage of a hub ring made of a metallic material is to be seen in its good thermal conductivity, its great mechanical strength and its good workability. The disadvantage with such hub rings is the comparatively great weight, the high energy requirement resulting from this during frequently occurring braking and starting events, for example, during starting spinning of the open-end spinning machine, and the comparatively high price of metallic materials.

Hub rings made of polymeric materials are also known from the related art. A hub ring made of polymeric material is of advantage, because of its low weight as well as its simple and cost-effective manufacturability. Hub rings made of polymeric materials have the disadvantages of considerably lower heat conductivity and lower mechanical strength compared to metallic materials. Because of the relaxation of many plastics, there is a danger that the press fit between the drive shaft and the hub ring may loosen with increasing time of use, and that the hub ring will change its position with respect to the shaft.

SUMMARY OF THE INVENTION

The present invention is based on the object of developing further a supporting disk, of the kind named at the beginning, in such a way that the supporting disk has a good thermal conductivity, a sufficiently great mechanical strength, a low weight, as well as being producible in a cost-effective manner. The low weight is intended to reduce to a minimum the energy demand during braking and starting when starting spinning in the open-end spinning machine.

The object of the present invention is achieved by the features of claim 1. The dependent claims refer to advantageous refinements.

To attain the object, it is provided that the hub ring is developed as a composite part and is made of at least two different materials. The advantageous properties of each material are thereby used in optimal fashion for partial areas of the object to be attained. Disadvantageous properties of each material do not have a disadvantageous influence on the working properties of the supporting disk, but are compensated for by the positive properties of the other material in each case.

According to one advantageous development, it can be provided that the hub ring includes a metallic and a polymeric material which are connected to each other in a force-locking or a form-locking manner. It is an advantage with such a choice of materials that the metallic material involves good thermal conductivity and great mechanical strength, as well as good workability, while the polymeric material contributes measurably to the low weight of the supporting disk and to its cost-effective manufacturing. In that case the metallic part of the hub ring can be reduced to the minimum that is technically necessary. Through the combination of metallic and polymeric materials, each of the materials contributes only its advantageous properties, so that the hub ring is optimized overall with regard to its working properties as well as in regard to its economical manufacturability.

The hub ring can be formed by a disk made of a metallic material which is overlapped at least partially by at least one plastic element. Preferably the disk is made as an aluminum disk. The aluminum disk brings about good thermal conductivity out of the support ring, on which the rotor runs, into the surroundings, and a sufficient mechanical strength of the hub ring. Since the size of the aluminum disk is reduced to the minimum technically necessary, and the remainder of the hub ring, on the other hand, is formed by the plastic element, the supporting ring has only a low weight overall, and can be made simply and cost-effectively. The plastic element is used, for example, for obtaining a sufficiently large surface for fixing the supporting ring and/or a sufficiently large seat for the pressure fit with which the hub ring is pressed onto the shaft or onto a journal on the shaft. The aluminum disk can have a thickness between 0.5 mm and 6 mm, preferably 3 mm.

The circumference of the plastic element and the inner circumference of the supporting ring can be connected to each other by force-locking or form-locking. It has proven especially advantageous for the plastic element and the supporting ring to be connected to each other by force-locking and form-locking. In this connection it can be provided that, in a first method step, at first the aluminum disk is extrusion-coated with the polymeric material of which the plastic component is made, in order thereby to make the hub ring. In a further, second method step the polymeric material of the supporting ring is, for example, deposited on the completed hub ring also by injection molding.

Aside from the use of an injection molding process, the supporting ring can also be pressed on or poured on, for example. Beyond that, there is the possibility of applying a two-component injection molding process, in the injection molding process, in general, the same machine being used for producing the hub ring and the supporting ring. The hub ring, for example, can be made of a thermoplastic, and the supporting ring, on the other hand, can be made of a thermoplastic polyurethane. In such a method, investment costs for the production equipment are only very low.

In view of the method steps according to which the aluminum disk, which may be stamped, for example, is first of all extrusion coated with plastic to create the hub ring, the hub ring subsequently being extrusion coated with the material of the supporting ring, it is of advantage that the strength of the processed materials decreases with each working step. The advantages lie in the handling, and since the harder precursor product in each case acts in a stabilizing manner the product is easy to handle at each point in time of manufacturing. By contrast, handling would be substantially more difficult using an opposite sequence, if, for example, one had to work on a soft supporting ring.

Since the plastic of the hub ring is very hard and strong compared to the material of the supporting ring, and melts at higher temperatures, it is possible to produce the plastic regions of the hub ring with great dimensional precision and to handle them with ease. This dimensional precision is not even influenced in a negative way by the hotly sprayed on but lower melting material of the supporting ring. The tying-up of the manufacturer's capital in semi-finished products is relatively low, since both the aluminum disk, especially when it is stamped, is produced very cost-effectively, and the plastic for the hub ring, which, compared to the plastic of which the supporting ring is made, is also favorable.

However, it is also possible to extrusion-coat the aluminum disk in a first method step with the polymeric material of the supporting ring, and subsequently, in a second method step, to spray the supporting geometries in hard plastic, e.g. using the injection molding method, onto the preassembled unit made up of the aluminum disk and the supporting ring. Since the harder plastic for the hub ring melts only at higher temperatures than the material of which the supporting ring is made, an appropriate selection of plastic can bring about fusing of the hub ring plastic with the supporting ring material, and therefore a good bonding of the two materials. As the material, glass fiber-reinforced polyurethane, for example, comes into consideration.

The overlapping of the aluminum disk with a plastic element takes place only in partial regions in which this is also technically necessary.

The circumference of the plastic element and the inner circumference of the supporting ring can be connected to each other by force-locking or form-locking. In addition to a mechanical engagement of the supporting ring with the aluminum disk, such an embodiment brings about an engagement of the supporting ring with the plastic element. This leads to an excellent strength of connection between the hub ring and the supporting ring, even during long duration of use at high rotational speeds of the supporting disk under high load. Even with great flexing work of the supporting ring, the heat is speedily conducted away into the surroundings by the aluminum disk, and thereby loosening of the supporting ring from the hub ring is reliably avoided.

In order to achieve a force-locking and a form-locking connection, it can be provided that the outer circumference of the plastic element is equipped with at least one undercut running around the circumference, into which at least one congruent projection of the supporting ring engages. The outer circumference of the plastic element can, for example, be undercut in essentially swallow's tail shape, the swallow's tail-shape undercuts being completely filled up with polymeric material of the supporting ring.

With a view towards simple and cost-effective manufacturing of the hub ring, the aluminum disk is preferably bordered by two flat faces.

Because the faces are flat, the aluminum disk can be formed as a stamped part. It is therefore possible to manufacture the hub ring easily and cost-effectively.

The plastic element is preferably formed as an injection molding part, and, for the purpose of manufacturing the hub ring, is sprayed directly onto the aluminum disk, Because the aluminum proportion of the hub ring is small compared that of a hub ring made entirely of aluminum, the hub ring of the supporting disk, according to the present invention, has a low weight and, in addition, manufacturing costs are substantially reduced by the low aluminum proportion.

The aluminum disk and the plastic element preferably have an essentially matching thermal expansion coefficient.

As polymeric materials for the plastic element, PBTB (polybutylene terephthalate), PETP (polyethylene terephthalate), PE (polyethylene), PA (polyamide), RTPU (reinforced thermoplastic polyurethane), PP (polypropylene), PC (polycarbonate), ABS (acrylonitrile butadiene styrene) and additional plastics having similar melting ranges and similar physical properties preferably find application. In order to achieve a similar coefficient of thermal expansion to the extrusion-coated metal part, the plastic has a glass fiber proportion, carbon fiber proportion, aramid fiber proportion or alternative fiber reinforcing materials between 15 and 60%, preferably 30%.

These materials each have a thermal expansion coefficient which essentially corresponds to the thermal expansion coefficient of aluminum. During normal use of the supporting disk, because differing thermal expansions between the aluminum disk and the plastic element are avoided, no stresses at all are created in the region of the connection of the two materials, so that detachment of the materials from each other during use of the supporting disk is reliably excluded. Independently of the created heat, the supporting disk according to the present invention has excellent dynamic balance characteristics, in spite of its low weight and the different materials of which the hub ring is made. Because of the low weight, tolerances depending on manufacturing and imbalances in a light supporting disk have a substantially lesser effect than in the case of supporting disks having a fully metallic hub ring.

According to one advantageous embodiment it can be provided that the supporting ring, seen in longitudinal section, has a largely convex outer circumference. Such an embodiment leads to a defined force flow in the hub ring designed as composite part. Because of a slight convexity, the greatest stress of the supporting ring is definably generated in the middle region of the supporting ring, whereby the lateral, supported plastic regions of the hub ring are unloaded. Thus, the force flow is brought definably onto the journal via the middle region, the aluminum disk. Furthermore, the region of greatest flexing work, and thus of the greatest heat development, is specifically generated in the middle region; therefore, good dissipation of heat by the aluminum disk is provided for.

It has proven particularly advantageous if the aluminum disk has a central opening which is surrounded radially on the outside, on a first reference circle, by first bores uniformly distributed in the circumferential direction; the first bores surrounding the central opening directly adjoining in the radial direction; on a second reference circle in the region of the outer circumference of the aluminum disk through holes being arranged distributed uniformly in the circumferential direction; in the radial direction, essentially centrically between the boundary of the through holes and the outer circumference of the aluminum disk second bores being arranged; and the first bores and the through holes each being penetrated by material of the plastic element and the second bores being penetrated by material of the supporting ring. In in this connection, the second bores are arranged on a third reference circle which is closest adjacent to the outer circumference of the aluminum disk in the radial direction. The first bores, the through holes and the second bores, these each being penetrated by polymeric material, effect an excellent engaging of the parts of the hub ring, designed as a composite part, secured to one another.

The central opening of the aluminum disk can be extended in the axial direction on both sides into the plastic element. Because the hub ring is held on the shaft with its central opening by a pressure fit, it is necessary to design the specific compressive load per unit area between the hub ring and the shaft in such a way that, on the one hand, there is a secure connection between the parts and, on the other hand, the materials of the parts secured to one another are not overly stressed. A satisfactory pressure fit between the shaft and the supporting disk cannot be achieved only by the central opening of the aluminum disk which is preferably 0.5 to 6 mm thick. For that reason, on both sides in axial direction, there is the adjoining plastic element 5, whereby the central opening of the hub ring is extended in the axial direction.

BRIEF DESCRIPTION OF THE DRAWINGS

FIG. 1 a first exemplary embodiment of a supporting disk according to the present invention in a representation in longitudinal section, FIG. 2 an elevation of an aluminum disk which is used in the hub ring in FIG. 1, FIG. 3 a longitudinal section of the aluminum disk in FIG. 2, FIG. 4 a further exemplary embodiment of an aluminum disk, which, with respect to the aluminum disk in FIG. 2, differs in the way it is formed in the region of its outer circumference, FIG. 5 a longitudinal section of the aluminum disk in FIG. 4, FIG. 6 a longitudinal section of a hub ring for a supporting disk, FIG. 7 an enlarged section of FIG. 6, FIG. 8 a supporting disk having a hub ring, the hub ring including two aluminum parts, FIG. 9 a further exemplary embodiment of a supporting disk, in which the supporting ring is furnished with a convex outer circumference, FIG. 10 a still further exemplary embodiment of a supporting disk according to the present invention in a representation in longitudinal section, FIG. 11 a side view of the supporting disk in FIG. 10 and FIG. 12 yet another exemplary embodiment of a supporting disk according to the present invention, having a differently formed hub ring.

DETAILED DESCRIPTION

Figure 1:
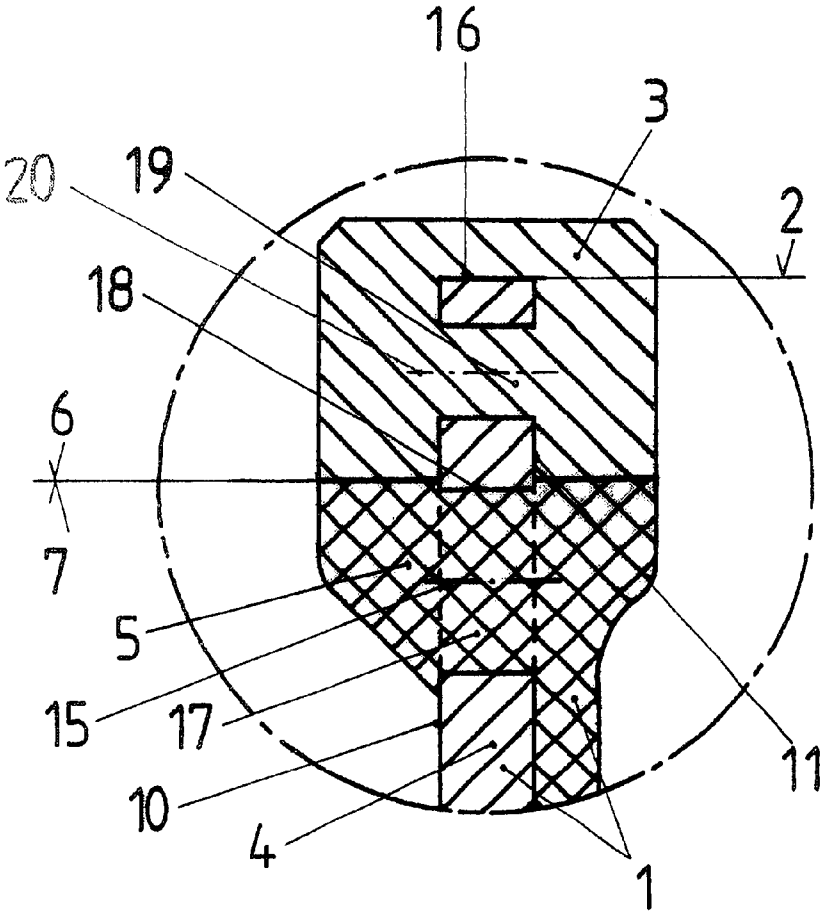
FIGS. 1 through 9 show exemplary embodiments of the supporting disk which are described in greater detail in the following. These each show in schematic representation.
Figure 1:
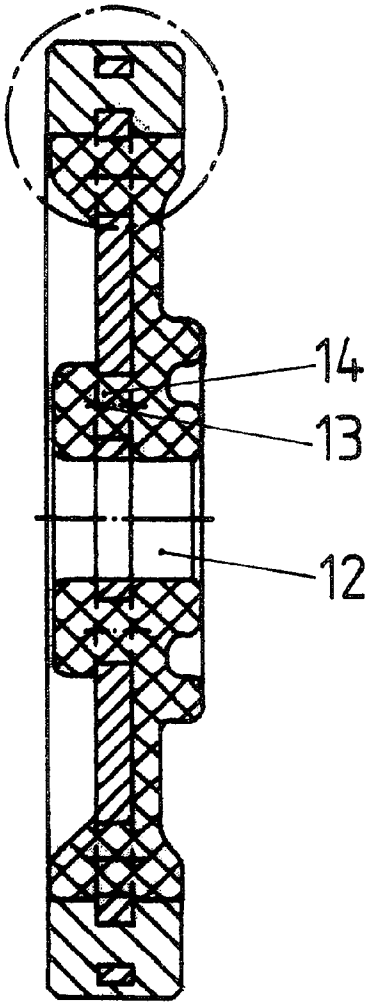

A first exemplary embodiment of the supporting disk according to the present invention is shown in FIG. 1. The supporting disk is used in an open-end spinning machine to support a rotor, and it includes a hub ring 1, a supporting ring 3 made of polymeric material being secured to the disk's outer circumference 2. Hub ring 1 is designed as a composite part and includes, in this exemplary embodiment, an aluminum disk 4 and a plastic element 5. An optimization with regard to weight and production costs of the hub ring, and thus of the supporting disk, is achieved by the combination of aluminum disk 4 with plastic element 5.

Plastic element 5 is deposited on the surface of the aluminum disk by an injection molding process, and is connected with it with form-locking and force-locking by a mechanical engagement and an adhesive connection.

Exactly the same force-locking and form-locking connection exists between outer circumference 6 of plastic element 5 and inner circumference 7 of supporting ring 3, supporting ring 3 also being connected to the aluminum disk with force-locking and form-locking.

Figure 2:
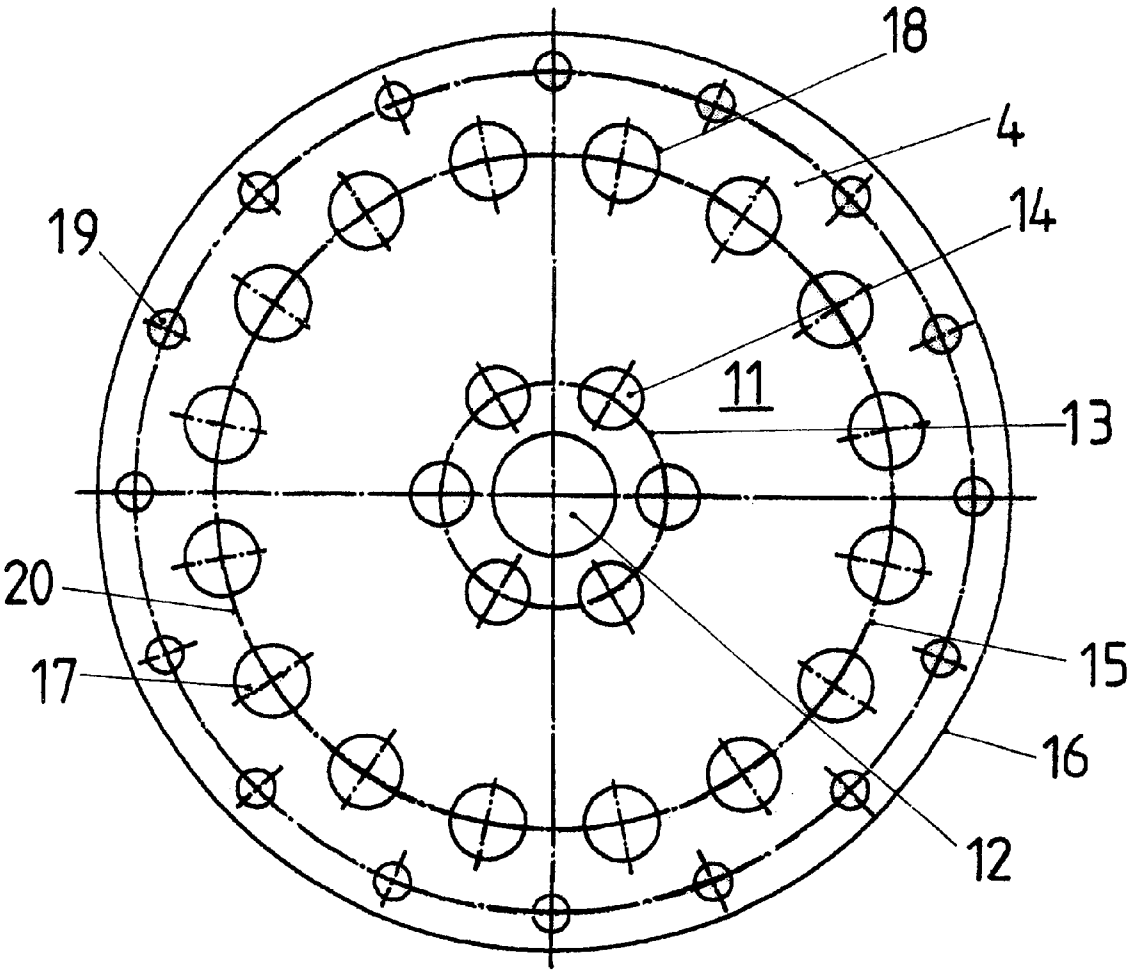

In FIG. 2, aluminum disk 4 of hub ring 1 is shown in projection. Aluminum disk 4 is bounded by two flat end faces 10, 11 and is formed by stamping. During normal use, central opening 12 of aluminum disk 4 has the journal of a roller bearing going through it. Radially outside opening 12, first bores 14 are arranged along a first reference circle 13 and are penetrated by the polymeric material of plastic element 5, just as in the case of through holes 17 which are arranged on a second reference circle 15, in order to achieve a force-locking and a form-locking connection. The second bores 19, which are arranged on a third, outer reference circle 20, are formed smaller in comparison to the diameter of the first bores and/or the through holes. The second bores 19 are penetrated by the material of supporting ring 3 for the engagement of hub ring 1 with supporting ring 3. In the exemplary embodiment shown here, aluminum disk 4 has a thickness of 3 mm.

Figure 3:
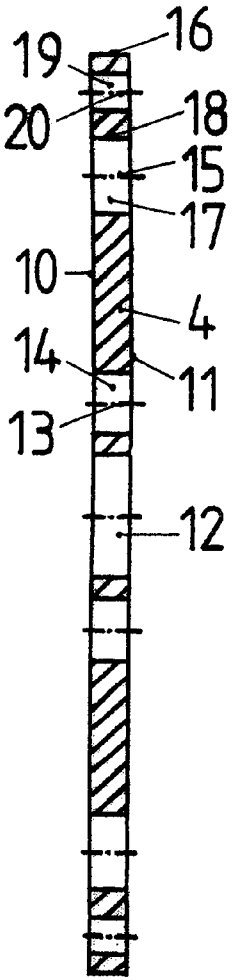

In FIG. 3, aluminum disk 4 in FIG. 2 is shown in longitudinal section. The diameters of first bores 14 and through holes 17 are actually essentially equal, the ratio of the diameter of first bores 14 or through holes 17 to the diameter of second bores 19 being essentially two [to one].

Figure 4:
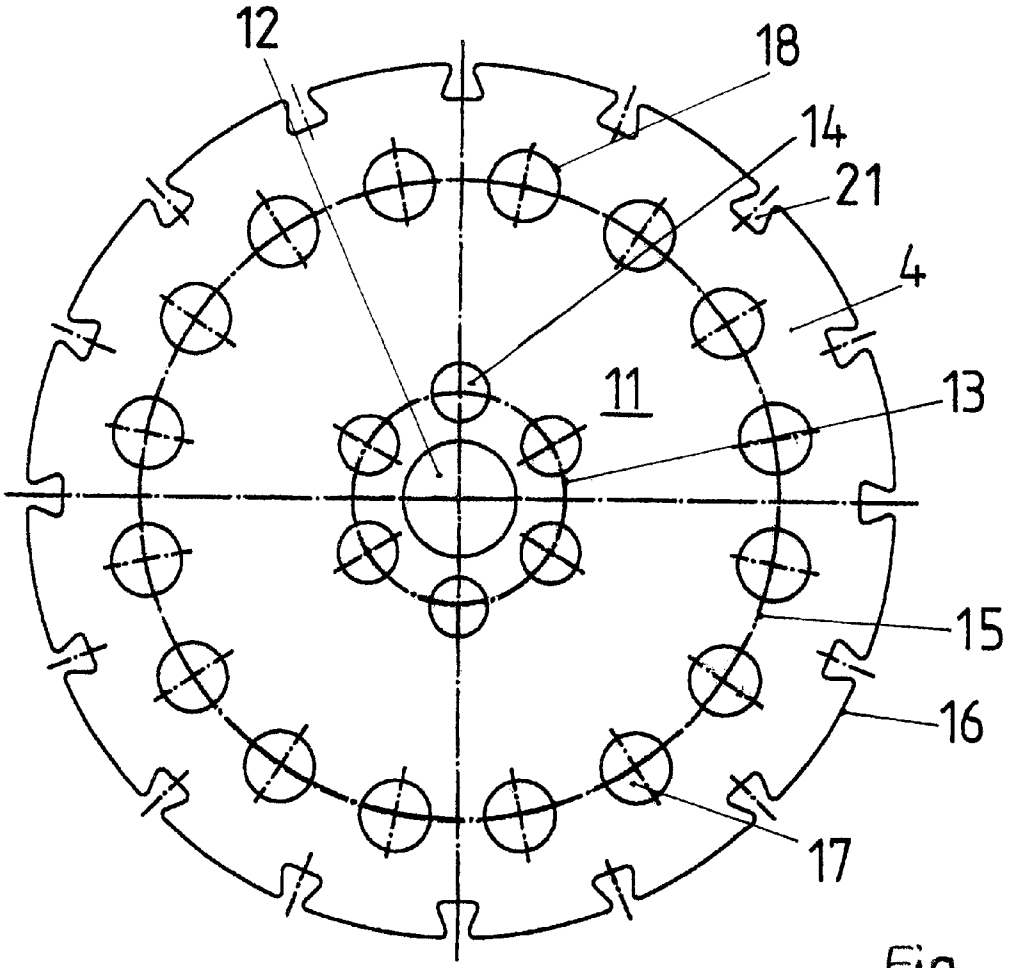
Figure 5:
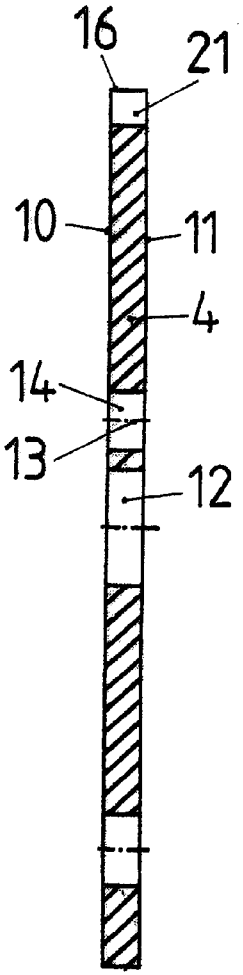

FIG. 4 shows an aluminum disk 4 which, in the region of its outer circumference 16, has a form varying from aluminum disk 4 shown in FIG. 2. Radially on the exterior, aluminum disk 4 is provided with through cuts 21 which are essentially swallow's tail-shaped, as seen in cross section. The crucial part of this is, that the radially outer opening cross section is smaller as compared to the groove base of the through cuts, and that this yields an undercut. Following the extrusion-coating of outer circumference 16 of aluminum disk 4 with supporting ring 3, the swallow's tail-shaped through cuts 21 are completely filled with the material of supporting ring 3. Supporting ring 3 and aluminum disk 4 are very durably connected to each other.

The dimension size of the swallow's tail-shaped through cuts 21 does not differ substantially from the dimension sizes of the second bores 19 of aluminum disk 4 in FIG. 2.

Figure 6:
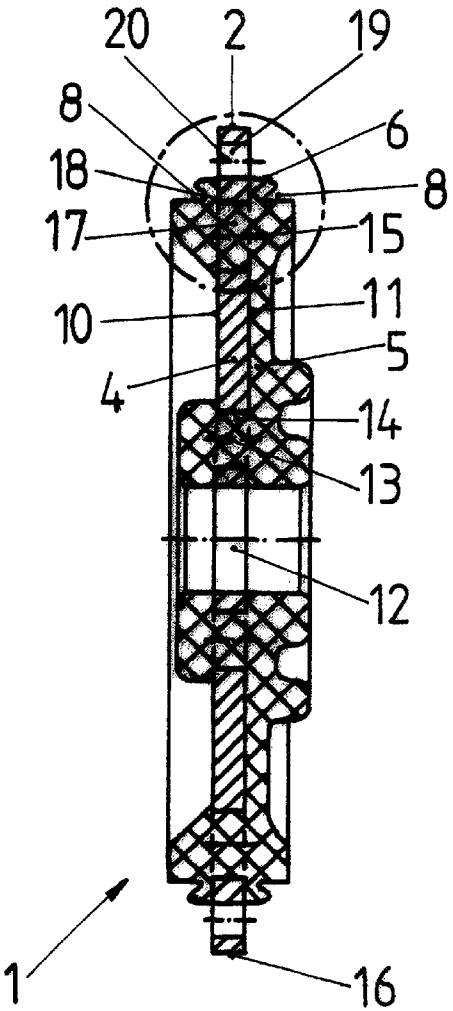

FIG. 6 shows an exemplary embodiment of a complete hub ring 1. Hub ring 1 is made of aluminum disk 4 and plastic element 5, which are connected to each other. Aluminum disk 4 corresponds to the aluminum disk 4 in FIG. 2, plastic element 5 being sprayed onto aluminum disk 4. In the region of outer circumference 6, plastic element 5 has undercuts into which projections 9 of supporting ring 3 engage. The connection between supporting ring 3 and outer circumference 6 of plastic element 5 is force-locking and form-locking, since the polymeric material of the supporting ring has been sprayed onto hub ring 1 illustrated here. FIG. 6 shows that first bores 14 and through holes 17 are penetrated by polymeric material of plastic element 5. It also shows that central opening 12 of aluminum disk 4 continuous in the axial direction on both sides into plastic element 5, so that there is formed a comparatively wide contact area for the press fit between hub ring 1 and the machine element penetrating central opening 12, such as a journal. Looked at centrically in the axial direction, central opening 12 is bordered by aluminum of aluminum disk 4. In the axial direction on both sides plastic element 5 adjoins the aluminum disk, plastic element 5 also bordering central opening 12 on its outer circumference. Due to the regions of plastic element 5 bordering axially on central opening 12 of the aluminum disk, a lubricating effect is brought about during pressing of the supporting disk onto a shaft, so that the journal can be pressed in in an excellent fashion. Because the plastic material extends axially on both sides of aluminum disk 4, lubricating the bordering wall of central opening 12 with mounting grease can be omitted. Since no lubrication is necessary during assembly, the assembly can be carried out considerable more simply.

Figure 7:
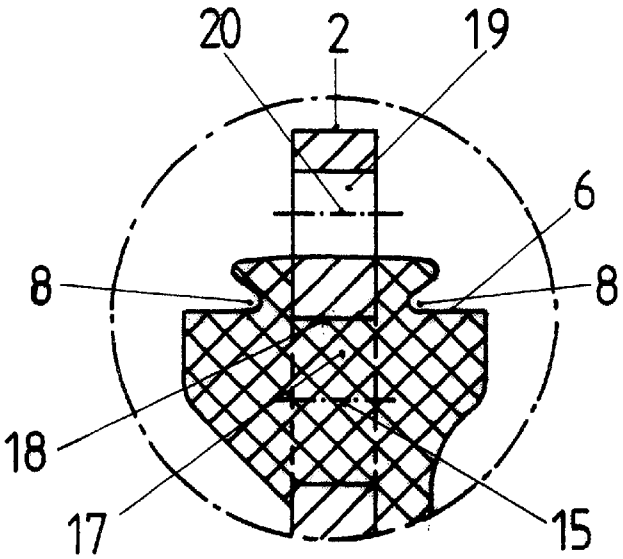

In FIG. 7, component part x of FIG. 6 is shown enlarged. The engaging between outer circumference 6 of plastic element and support ring 3 which is sprayed on it later is essentially Ω-shaped, the polymeric material of the supporting ring penetrating also second bores 19, which are arranged in the region of outer circumference 16 of aluminum disk 4. Because aluminum disk 4 extends in the radial direction almost up to the running surface of the supporting ring, excellent heat dissipation is guaranteed from the coating of the supporting ring to the surroundings, and, because of that, the supporting disk has, overall, invariably good application properties during a long service life.

The heat expansion coefficients of aluminum disk 4 and of plastic element 5 are essentially equal.

Figure 8:
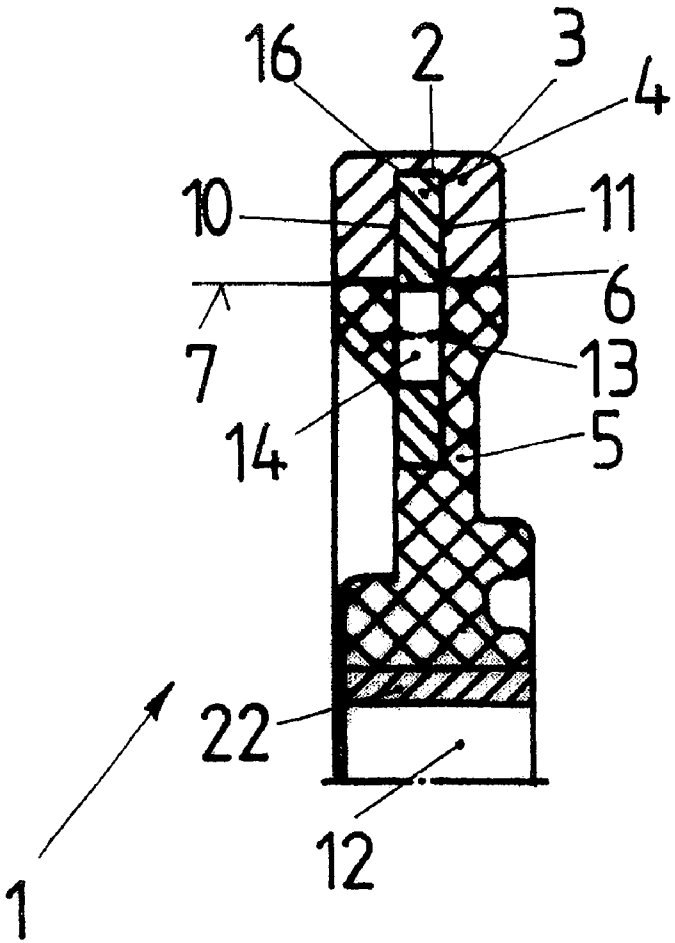

FIG. 8 shows a further exemplary embodiment of a supporting disk, for which, in addition to aluminum disk 4, a further insertion part 22 is provided, as described before, which is extrusion-coated with polymeric material of plastic element 5, is also made of aluminum and also pressed onto the rotor of the open-end spinning machine, using a press fit. In the radially outer region of the hub ring a material could, for example, be used which has a better heat conductivity in comparison to aluminum, e.g. copper. However, for reasons of cost and/or weight, should be held volume-wise to as low as possible. In the radially inner region a very cost-effective sleeve made of a metallic material could be used, which would not have to have special heat conductivity. However, good fitting properties are required here, for securing the supporting disk to a shaft. The radially inner sleeve can be made of steel, for example.

Figure 9:
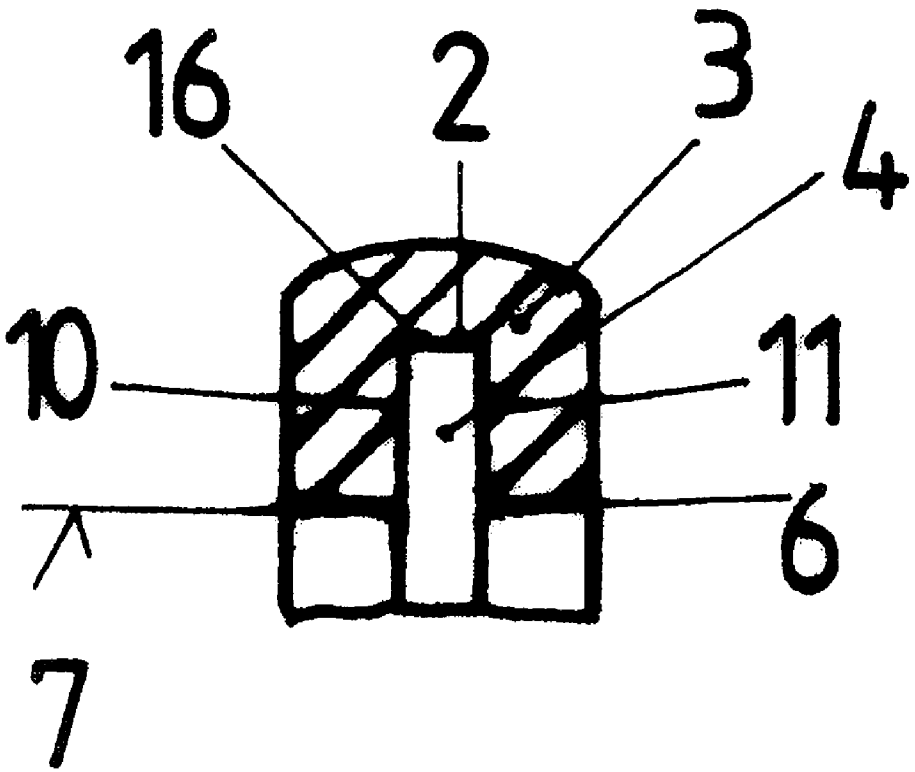

FIG. 9 shows the outer circumference of a supporting disk. Outer circumference 16 of aluminum disk 4 is enclosed by polymeric material of supporting ring 3 to make possible a good heat dissipation. Plastic element 5 is arranged axially on both sides of aluminum disk 4 in the region of the two end faces 10, 11, and at the same time, on its outer circumference, it forms an interface and supporting surface for the inner circumference of supporting ring 3.

Supporting ring 3 is furnished with a convex outer circumference, as seen in cross section.

Figure 10:
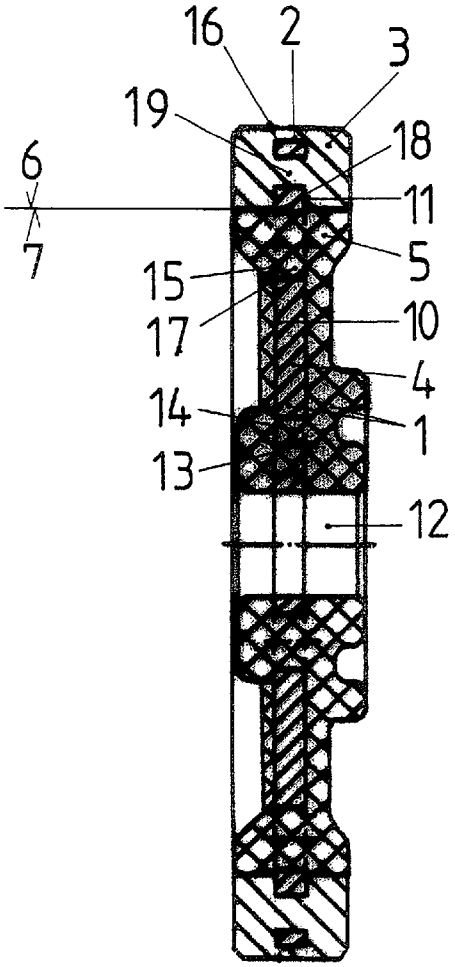

FIG. 10 shows an exemplary embodiment, similar to the exemplary embodiment in FIG. 1, in which the plastic element has a ribbing 25 in each case in the region of its two axial end faces 23, 24, and in which the individual ribs 26 of ribbing 25 extend in each case in the radial direction, so as By to make possible as good as possible a heat transfer from heated aluminum disk 4 into the surroundings. Only ribs 26 touch adjoiningly end faces 10, 11 of aluminum disk 4. During normal use of the supporting disk, ribs 26 lead to further air turbulence, and thereby to a ventilator-like cooling effect.

Figure 11:
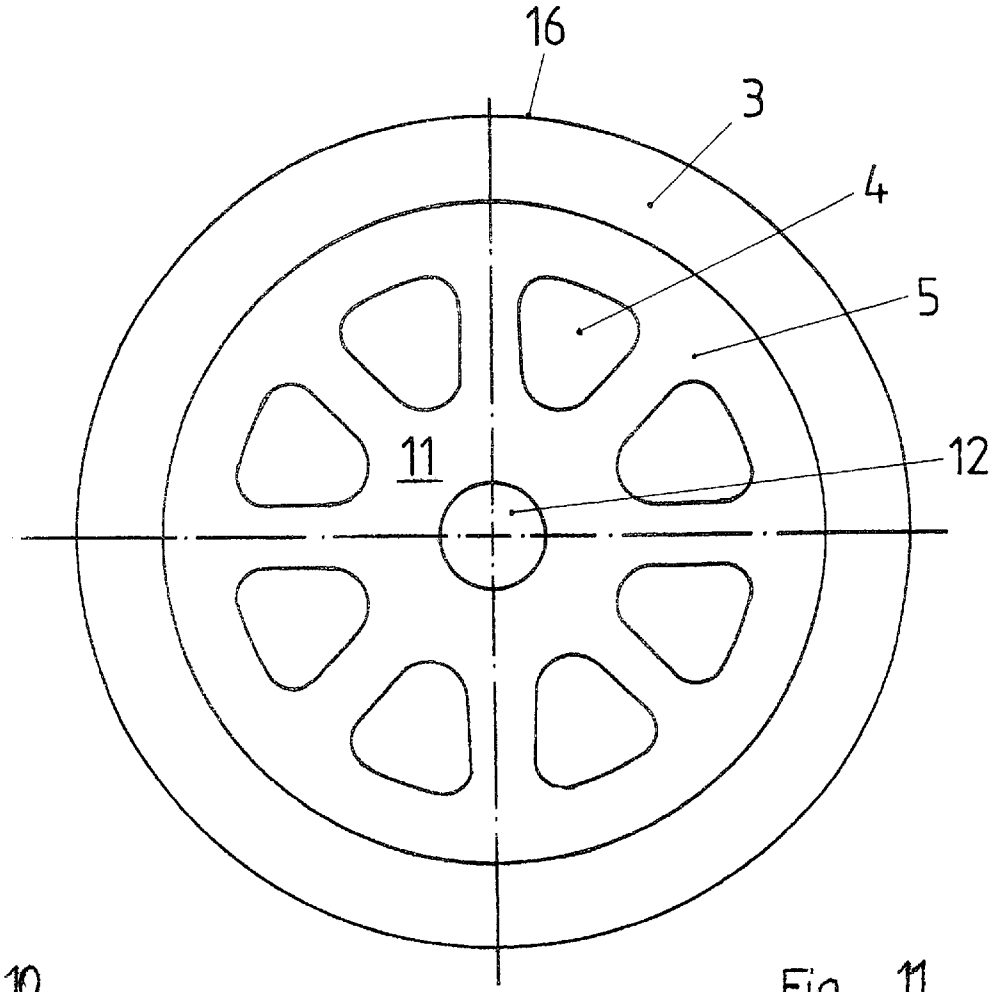

FIG. 11 shows a side view of the supporting disk in FIG. 10.

Figure 12:
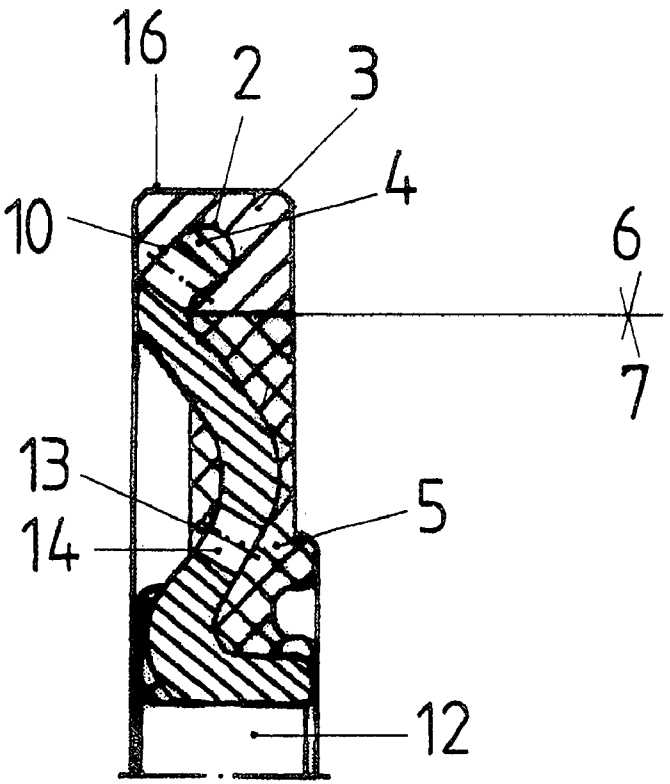

FIG. 12 shows a further exemplary embodiment of a supporting disk. The metal part of hub ring 1 extends radially outward in wave form, this insertion part being made by a nonwoven fabric press method, die-cast method, or a drawing, bending or alternative reshaping method. In using such an insertion part, it is of advantage that the bordering wall of central opening 12 has the right bore diameter for a press fit, and that it is made predominantly of metal. As a cost-effective material, steel sheet comes into consideration.

LIST OF REFERENCE NUMERALS

1 Hub ring
2 Outer circumference of the hub ring
3 Supporting ring
4 Aluminum disk
5 Plastic element
6 Outer circumference of 5
7 Inner circumference of 3
8 Undercut in 6
9 Projection of 3
10 First end face of 4
11 Second end face of 4
12 Central opening in 4
13 First reference circle
14 First bore on 13
15 Second reference circle
16 Outer circumference of 4
17 Through holes on 15
18 Radially outer boundary of 17
19 Second bores
20 Third reference circle of 19
21 Swallow's tail-shaped cut throughs
22 Second insertion part
23 First end face of 5
24 Second end face of 5
25 Ribbing
26 Ribs

What is claimed is:

1. A supporting disk for supporting a rotor of an open-end spinning machine, comprising a hub ring and a supporting ring made of polymeric material secured to its outer circumference, wherein the hub ring (1) is formed as a composite part and is made of at least two different materials.

2. The supporting disk according to claim 1, wherein the hub ring (1) includes a metallic and a polymeric material which are connected to each other in a force-locking or a form-locking manner.

3. The supporting disk according to claim 1, wherein the hub ring (1) is formed by a disk made of metallic material (4) which is overlapped at least partially by at least one plastic element (5).

4. The supporting disk according to claim 2, wherein the hub ring (1) is formed by a disk made of metallic material (4) which is overlapped at least partially by at least one plastic element (5).

5. The supporting disk according to claim 3, wherein the disk is formed as an aluminum disk (4).

6. The supporting disk according to claim 3, wherein an outer circumference (6) of the plastic element (5) and an inner circumference (7) of the supporting ring (3) are connected to each other by force-locking or form-locking.

7. The supporting disk according to claim 3, wherein an outer circumference (6) of the plastic element (5) is furnished with at least one undercut (8) running around on the circumference side, into which at least one congruently formed projection (9) of the supporting ring engages.

8. The supporting disk according to claim 5, wherein the aluminum disk (4) is bordered by two flat end faces (10, 11).

9. The supporting disk according to claim 5, wherein the aluminum disk (4) is formed as a stamped part and the plastic element (5) is formed as an injection-molded part.

10. A supporting disk for supporting a rotor of an open-end spinning machine, comprising a hub ring and a supporting ring made of polymeric material secured to its outer circumference, wherein the hub ring (1) is formed as a composite part and is made of at least two different materials, the hub ring (1) is formed by a disk made of metallic material (4) which is overlapped at least partially by at least one plastic element (5) the disk is formed as an aluminum disk (4), and the aluminum disk (4) and the plastic element (5) have an essentially identical thermal expansion coefficient.

11. The supporting disk according to claim 1, wherein the supporting ring (3) has an essentially convex outer circumference (2), as seen in longitudinal cross section.

12. The supporting disk according to claim 2, wherein the supporting ring (3) has an essentially convex outer circumference (2), as seen in longitudinal cross section.

13. The supporting disk according to claim 3, wherein the supporting ring (3) has an essentially convex outer circumference (2), as seen in longitudinal cross section.

14. A supporting disk for supporting a rotor of an open-end spinning machine, comprising a hub ring and a supporting ring made of polymeric material secured to its outer circumference, wherein the hub ring (1) is formed as a composite part and is made of at least two different materials, the hub ring (1) is formed by a disk made of metallic material (4) which is overlapped at least partially by at least one plastic element (5) the disk is formed as an aluminum disk (4), and the aluminum disk (4) has a central opening (12) which is surrounded radially on the outside by first bores (14) uniformly distributed in the circumferential direction on a first reference circle (13), the first bores (14) directly surrounding the central opening contiguously in the radial direction, wherein through holes (17), uniformly distributed in the circumferential direction, are arranged on a second reference circle (15) in the region of the outer circumference (16) of the aluminum disk (14), second bores (19) being arranged in the radial direction essentially centrically, between the boundary (18) of the through holes (17) and the outer circumference (16) of the aluminum disk (4), and wherein the first bores (14) and the through holes (17) are each penetrated by the material of the plastic element and the second bores (19) are penetrated by the material of the supporting ring (3).

15. The supporting disk according to claim 14 wherein the central opening (12) of the aluminum disk (4) is extended in the axial direction into the plastic element (5) on both sides.

16. A supporting disk for supporting a rotor of an open-end spinning machine, comprising:

a hub ring formed of a composite part made of at least two different materials, a first one of the different materials including at least one end face, and a second one of the different materials contacting the at least one end face of the first one of the different materials; and a supporting ring made of polymeric material secured to an outer circumference of the hub ring.

17. The supporting disk according to claim 16, wherein the hub ring includes a metallic material and a polymeric material connected to each other in one of a force-locking manner and a form-locking manner.

18. The supporting disk according to claim 16, wherein the first one of the different materials and the second one of the different materials have an essentially identical thermal expansion coefficient.

19. The supporting disk according to claim 17, wherein an outer circumference of the polymeric material and an inner circumference of the supporting ring are connected to each other in one of a force-locking manner and a form-locking manner.

20. The supporting disk according to claim 17, wherein an outer circumference of the polymeric material is provided with at least one undercut, at least one congruently formed projection of the supporting ring engaging the at least one undercut.

* * * * *